US010391525B2

(12) United States Patent
Yanagawa

(10) Patent No.: US 10,391,525 B2
(45) Date of Patent: Aug. 27, 2019

(54) WASHING METHOD AND APPARATUS FOR REMOVING CONTAMINATIONS FROM ARTICLE

(71) Applicant: DENSO CORPORATION, Kariya, Aichi-pref (JP)

(72) Inventor: Keita Yanagawa, Anjyo (JP)

(73) Assignee: DENSO CORPORATION, Kariya (JP)

( * ) Notice: Subject to any disclaimer, the term of this patent is extended or adjusted under 35 U.S.C. 154(b) by 911 days.

(21) Appl. No.: 13/908,147

(22) Filed: Jun. 3, 2013

(65) Prior Publication Data

US 2013/0319468 A1 Dec. 5, 2013

(30) Foreign Application Priority Data

Jun. 5, 2012 (JP) ..... 2012-128277

(51) Int. Cl.
*C23G 1/00* (2006.01)
*C23G 3/00* (2006.01)
(Continued)

(52) U.S. Cl.
CPC ..... *B08B 3/10* (2013.01); *B08B 3/022* (2013.01); *B08B 7/0064* (2013.01); *C23G 1/00* (2013.01); *C23G 3/00* (2013.01)

(58) Field of Classification Search
CPC ..... B08B 3/022; B08B 3/10; B08B 7/0064; C23G 1/00; C23G 3/00
See application file for complete search history.

(56) References Cited

U.S. PATENT DOCUMENTS 2,549,619 A * 4/1951 Miskella ..... F26B 3/283 219/388
4,788,992 A * 12/1988 Swainbank ..... B08B 3/123 134/1
(Continued)

FOREIGN PATENT DOCUMENTS

CN 1914352 A 2/2007
DE 4406169 C1 * 5/1995 ..... B08B 3/022
(Continued)

OTHER PUBLICATIONS

Machine translation of JPH06-269839A dated Sep. 1994.*
(Continued)

*Primary Examiner* — Douglas Lee
(74) *Attorney, Agent, or Firm* — Oliff PLC

(57) ABSTRACT

A method for washing an article to remove contaminations such as oils and fats, foreign substances and the like from a surface of the article is provided. The washing method comprises the steps of: cooling a washing solution to obtain a super-cooled washing solution; heating an article to increase its surface temperature to the temperature which is not lower than the boiling point of the washing solution; and washing and drying the article concurrently, while spraying the super-cooled washing solution to the heated article. The washing apparatus for carrying out this washing method is also provided. Using these washing method and apparatus, it becomes possible to downsize a scale of the washing apparatus, and to operate the washing apparatus under the energy-saving conditions as a result of reduction in an amount of the consumed energies, and the washing process at an accelerated speed.

3 Claims, 4 Drawing Sheets

(51) Int. Cl.

| | |
|---|---|
| ***B08B 3/10*** | (2006.01) |
| ***B08B 3/02*** | (2006.01) |
| ***B08B 7/00*** | (2006.01) |

(56) References Cited

U.S. PATENT DOCUMENTS

| | | | | |
|---|---|---|---|---|
| 5,333,628 | A | 8/1994 | Ogata et al. | |
| 5,762,749 | A * | 6/1998 | Suzuki | B08B 3/022 156/345.22 |
| 5,957,367 | A * | 9/1999 | Matsuo | B21B 15/0085 228/158 |
| 2005/0172984 | A1 | 8/2005 | Schweitzer et al. | |
| 2006/0130886 | A1 * | 6/2006 | Tada | B08B 7/0092 134/198 |

FOREIGN PATENT DOCUMENTS

| | | | | |
|---|---|---|---|---|
| JP | 05177542 | A * | 7/1993 | B08B 7/0092 |
| JP | 05177542 | A * | 7/1993 | B08B 7/0092 |
| JP | 06269839 | A * | 9/1994 | |
| JP | 10140312 | A * | 5/1998 | |
| JP | 10140312 | A * | 5/1998 | |
| JP | A-10-223587 | | 8/1998 | |
| JP | A-2005-501777 | | 2/2000 | |
| JP | B2-3030313 | | 4/2000 | |
| JP | B2-3030314 | | 4/2000 | |
| JP | B2-3323304 | | 9/2002 | |
| JP | B2-4120991 | | 7/2008 | |
| JP | A-2008-229438 | | 10/2008 | |
| JP | A-2008-238110 | | 10/2008 | |
| JP | A-2008-264926 | | 11/2008 | |
| JP | 2008307624 | A * | 12/2008 | |
| JP | 2008307624 | A * | 12/2008 | |
| JP | A-2010-022855 | | 2/2010 | |
| JP | A-2010-022884 | | 2/2010 | |
| JP | A-2010-284572 | | 12/2010 | |
| KR | 20090109728 | A * | 10/2009 | |
| WO | WO 98/37163 | | 8/1998 | |

OTHER PUBLICATIONS

Machine translation of DE4406169 dated May 1995.*
Machine translation of JP2008-307624 dated Dec. 2008.*
Machine translation of JP2008-307624A dated Dec. 2008.*
Machine translation of JP10-140312A dated May 1998.*
Machine translation of JP05-177542A dated Jul. 1993.*
Machine translation of JP2008-307624A dated Dec. 2008 (Year: 2008).*
Machine translation of JP10-140312A dated May 1998 (Year: 1998).*
Machine translation of JP05-177542A dated Jul. 1993 (Year: 1993).*
Abstract of KR10-2009-0109728A dated Oct. 2009 (Year: 2009).*
Aug. 16, 2016 Office Action issued in Chinese Application No. 201310220404.7.

* cited by examiner

WASHING METHOD AND APPARATUS FOR REMOVING CONTAMINATIONS FROM ARTICLE

BACKGROUND OF THE INVENTION

1. Field of the Invention

The present invention concerns a method for washing an article to remove contaminations attached or adhered to the article. In other words, the present invention concerns a method for removing from the article, through washing, a wide variety of contaminations, in particular, oils and fats adhered to the article such as press molded products, typically oils and fluids used in molding and cutting processes; and foreign substances, typically cutting fragments. The present invention also concerns a downsized and energy-saving washing apparatus for carrying out the washing method of the present invention.

2. Description of the Related Art

In the production of electronics parts and mechanical parts, washing is generally applied to the parts as an article to be washed in order to remove contaminations adhered to the parts in order to ensure good qualities of the parts in the subsequent fabrication steps, and good qualities of the final products. A conventional method for washing the parts includes, for example, dipping the parts in a solvent capable of dissolving oils and fats such as a chlorinated solvent and a hydrocarbon solvent, or dipping the parts in an aqueous washing solution comprising an alkali or base, a surfactant and the like, or spraying such an aqueous washing solution to the parts.

Generally speaking, the washing system is classified into two groups, i.e., dry washing system and wet washing system. For example, a washing system using a washing solution is classified under the category "wet washing". However, since it includes the washing step of the parts with a washing solution to remove the contaminations, the rinsing step to remove the used washing solution from the parts, the removing step of the used rinsing solution, and the drying step, the wet washing system has to be carried out with an increased number of the steps in comparison with the dry washing system, and thus is not a reasonable washing method. Further, since a much amount of energies are required in the wet washing system, there arise another problem of reducing an amount of exhausted carbon dioxide ($CO_2$) gas, in other words, energy-saving problem.

Further, in addition to the dry washing system and wet washing system described above, the washing system may be classified in view of its washing mechanism. In such a case, the washing system is classified under the following two groups, i.e., washing relied upon a chemical function and washing relied upon a physical function. For the washing of parts, washing is frequently carried out based on a combination of the chemical function and the physical function in order to increase an efficiency of washing. That is, for the purpose of increasing an efficiency of washing, parts are dipped in a washing solution in order to chemically dissolve oils and fats in the solution, followed by applying a physical action such as ultrasonic treatment to the washed parts.

As an example, washing of heat exchanger products will be explained hereinafter.

For example, when the heat exchanger is made of aluminum-made parts, parts are produced from an aluminum material with press molding, and then the press molded parts are assembled to form an article having a desired shape, followed by subjecting the parts to a bonding step such as soldering in order to obtain a heat exchanger product. In such a production of the heat exchanger product, it is necessary to wash the press molded parts in order to remove from a surface of the parts a remainder of the fabrication oil used with the press molding and adhered to the parts, and cutting fragments (foreign substances), as well as fine or small particulates and/or burrs appearing on a cut surface of the parts. As is described in, for example, Japanese Patents No. 3030313 and 3030314, washing of the press molded parts as an article to be washed is carried out by immersing the parts in a washing solution, while continuously applying an ultrasonic radiation, in a continuous ultrasonic washing apparatus in order to peel off and remove the adhered contaminations from the parts. However, the washing methods described in these Japanese patent literatues suffer from drawbacks such as an increased level of energies consumed, a large-sized washing plant, and an increase of costs.

On the other hand, there is another washing method based on a compact peeling off/washing technology, according to which a super-cooled washing solution is sprayed against the parts. According to this washing method, the adhered contaminations can be peeled off and removed by spraying a super-cooled washing solution having a temperature of not more than its solidifying point from a spraying nozzle to the parts under an atmospheric pressure in order to peel off and remove the adhered contaminations from the parts. As is described in, for example, Japanese Patent No. 3323304, when it is contacted with the parts as an article to be washed, the washing solution in the state of a super-cooled washing solution can be changed from the super-cooled state to the corresponding solidified or frozen state. Upon freezing of the washing solution, a phase transfer of the washing solution from liquid to solid is caused with an expansion of the volume of the solution. As a result, the expanded and frozen washing solution can rub a surface of the parts in such a manner that the contaminations are removed from the surface of the parts.

Further, as is described in, for example, Japanese Unexamined Patent Publication (Kokai) No. 2008-264926, there is another washing method which comprises spraying to the parts a washing medium containing both the frozen particles of water and the liquid droplets in a super-cooled state from an ice blasting nozzle. The washing method is effective to remove small burrs from the surface of the parts.

However, when the super-cooled washing solution or medium containing both the frozen particles of water and the liquid droplets in a super-cooled state is sprayed against the parts of the heat exchanger product in order to wash the parts during washing process, there arises a problem that, after the washing process, liquid droplets formed upon melting of the frozen washing solution can remain on the washed parts. Further, a plurality of spraying nozzles have to be disposed at a multistage manner, thereby resulting in an increase of energies consumed, a large-sized washing plant, and an increase of costs. This is because press molding machine used in the production of the parts of the heat exchanger product can exhibit a highly increased production capability, and thus, when the press molding machine is directly disposed in combination with the subsequent washing plant, the washing plant has to be operated concurrently with the press molding machine, at the feeding speed of about 2 to 10 m/min. which is a speed of the longitudinal parts discharged from the press molding machine, while ensuring a high washing quality and a high washing speed.

SUMMARY OF THE INVENTION

The present invention is to solve the prior art problems mentioned above. That is, an object of the present invention is to provide a method and apparatus for washing an article in a washing area of the washing apparatus to remove contaminations such as oils and fats, foreign substances and others attached to a surface of the article, which method and apparatus enables to diminish an amount of energies consumed during washing, and to conduct the washing step and the subsequent drying step at a highly increased speed, thereby ensuring downsizing, reduction of the costs and continuous operation of the method and apparatus.

The inventor of this application has now found that the above problems can be effectively solved, if a specific washing system including use of a specific washing solution having an oleophobicity to any contaminations is applied to an article to be washed. That is, after the washing solution was modified to the corresponding super-cooled washing solution, the washing solution is used in the washing system having the specific constitution. According to the present invention, the removal of the contaminations from the article, the removal of the sprayed washing solution, and the drying of the washed article can be concurrently carried out in a single washing plant.

According to one aspect thereof, the present invention resides in a method for washing an article to remove contaminations on a surface of the article, which comprises the steps of cooling a washing solution to obtain a super-cooled washing solution;

heating an article to increase its surface temperature to the temperature which is not lower than the boiling point of the washing solution;

washing and drying the article concurrently, while spraying the super-cooled washing solution to the heated article. The contaminations are, for example, oils and fats, foreign substances, particulates, burrs and a combination thereof.

According to another aspect thereof, the present invention resides in an apparatus for washing an article to remove contaminations on a surface of the article, which comprises in series:

a heating area comprising a heating means disposed in an upstream side of a washing area, in which a surface temperature of the heated article is increased to the temperature which is not lower than the boiling point of a washing solution used; and a washing area for washing the heated article comprising a spraying apparatus for spraying a super-cooled solution against the heated article, the spraying apparatus comprising a solution-supplying tank for containing the super-cooled solution and a spraying nozzle connected with the solution-supplying tank;

wherein washing and drying of the heated article are concurrently carried out by spraying the super-cooled washing solution against the heated article in the washing area.

As is appreciated from the following descriptions, according to the present invention, when oils and fats, foreign substances and other impurities adhered to a surface of the article such as constitutional parts are removed through washing of the article in a washing apparatus, it becomes possible to downsize a scale of the washing apparatus, and also operate the washing apparatus under the energy-saving conditions, since the present invention is effective to reduce an amount of the consumed energies, and to conduct a washing process at an accelerated speed.

DESCRIPTION OF THE PREFERRED INVENTION

Figure 1:
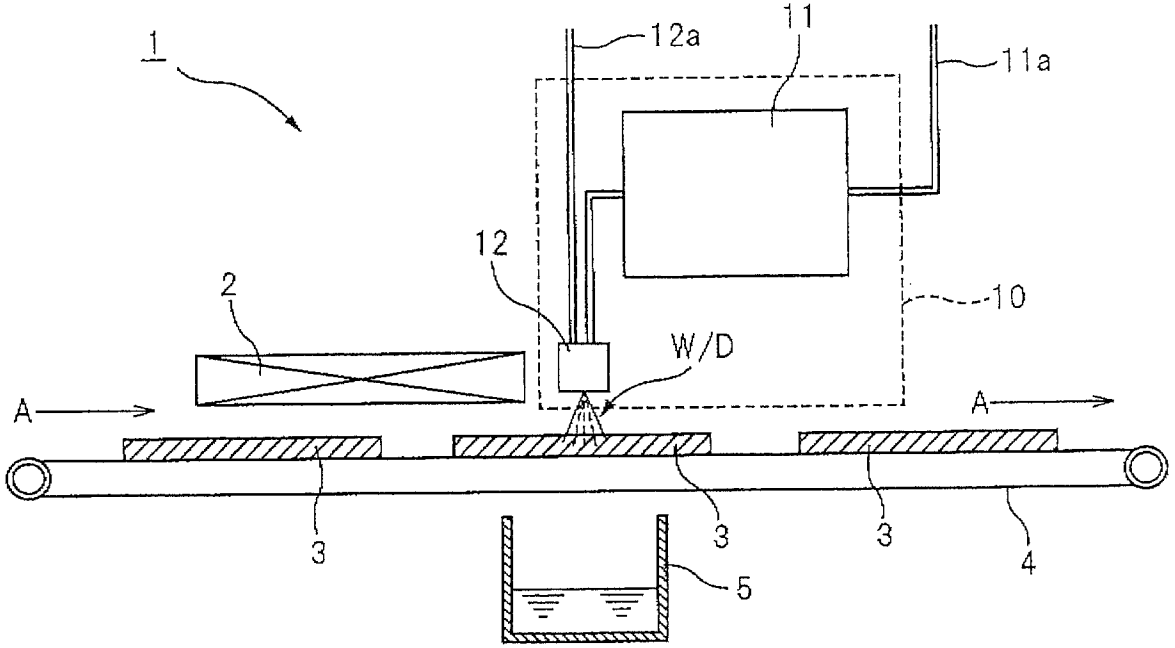
FIG. 1 illustrates one preferred embodiment of the washing apparatus according to the present invention.

The present invention can be advantageously carried out with different embodiments. The preferred embodiments of the present invention will be described hereinafter, but it should be noted that the present invention is not restricted to the following embodiments, and the embodiments of the present invention may be modified and improved within the scope and spirit of the present invention.

In the practice of the present invention, the following steps in series are carried out in sequence in a washing apparatus.

(1) preparing a super-cooled washing solution by cooling a washing solution until the corresponding super-cooled solution is produced;

(2) heating an article, i.e., article or part to be washed, to increase its surface temperature to the temperature which is not lower than the boiling point of the washing solution; and (3) washing and drying the heated article concurrently in the washing apparatus by spraying the super-cooled washing solution against the heated article.

The washing solution used herein is an inactive fluid or solution having an oleophobic property. Suitable washing solution includes, for example, an aqueous solution containing water and an antirust agent, and a fluorinated solvent (briefly "fluorosolvent") such as bydrofluorocarbon (HFC), hydrofluoroether (HFE), perfluoroether (PFE), perfluorocarbon (PFC), and perfluoroamine. Suitable antirust agent includes, for example, a nitrogen-containing compound, typically ethanolamine and monoethanolamine. Generally, the antirust agent is used in an amount of about 0.1 to 30% by weight on the basis of a total weight of the aqueous solution.

Further, if there is no adverse influence on the practice of the present invention, any conventional washing solutions such as aqueous alcohol and hydrocarbon liquid may be used as the washing solution. Furthermore, if desired, the washing solution may further comprise any optional additives such as inorganic compounds, typically sodium hydroxide and sodium silicate. Moreover, although it is generally used alone, the washing solution may be used in a combination of two or more solutions.

The washing solution is used in the present invention, after it was modified to the corresponding super-cooled state. Super-cooling of the washing solution can be carried out in accordance with the conventional methods well-known in the art. It is preferred that the super-cooled washing solution is applied in the form of sprayed droplets using a spraying nozzle or other spraying means against the article having the impurities on a surface thereof. Further, it is preferred that the droplets in the super-cooled state are sprayed against the article, after they were mixed with a separate flow of air to form a gas-liquid medium having two phases.

Further, when the washing solution is applied to the article to be washed, it is preferred that a surface of the article is previously heated to a surface temperature which is not lower than the boiling point of the washing solution. Such a preheating of the article is effective to previously remove relatively lighter oil and fat components from a surface of the article through evaporation and volatilization of the components.

When the gas-liquid washing solution described above is sprayed against the heated article having a surface temperature of not less than a boiling temperature of the washing solution, a sprayed flow of the washing solution can effectively remove foreign substances such as cutting fragments attached or adhered onto a surface of the article. In such an instance, the gas-liquid washing solution can be prepared in any conventional methods. Preferably, the gas-liquid washing solution can be prepared by mixing a washing solution and air in a widely variable mixing ratio (volume ratio), generally in a range of about 1:100,000 to about 1:1,000. Satisfactory effects could not be obtained if one or both of the washing solution and air is out of the above range.

When the super-cooled gas-liquid washing solution was sprayed against the heated article, there arises an impact of the washing solution to a surface of the article. As a result, a super-cooled state of the washing solution is released, and thus the washing solution is solidified, i.e., frozen. Upon freezing of the washing solution, a phase transfer of the washing solution from liquid to solid is caused with an expansion of the volume of the washing solution, and thus a surface of the article is subjected to a rubbing function of the expanded and frozen washing solution. Since the surface of the article is rubbed with the frozen washing solution, reminders such as remaining oils and fats and the like which were not evaporated or volatilized during the preheating step are removed, and at the same time, the frozen washing solution was immediately changed to the corresponding melted solution which is then evaporated or volatilized. That is, according to the present invention, since a surface of the article is heated to a temperature which is not less than a boiling temperature of the washing solution, a spontaneous phase transition (liquid→solid→gas) of the super-cooled droplets of the washing solution is caused in the sprayed gas-liquid two phase washing solution, thereby enabling to conduct a washing/drying process at a high speed.

Further, in the practice of the present invention, it is preferred that a spraying nozzle used to spray a washing solution against the article further comprises an air-supplying means, in combination with the spraying nozzle, to prepare a washing solution in the form of a gas-liquid medium having two phases. This is because, as mentioned above, spraying of the washing solution is preferably carried out by using a gas-liquid two phase washing solution. The air-supplying means may have any suitable configuration and size, and for example, the air-supplying means may be a conduit connected with an air source.

Figure 3:
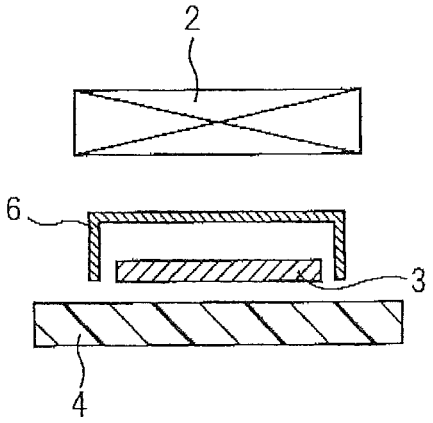
FIG. 3 illustrates a constitution around the heating area of the washing apparatus according to the present invention.
Figure 4:
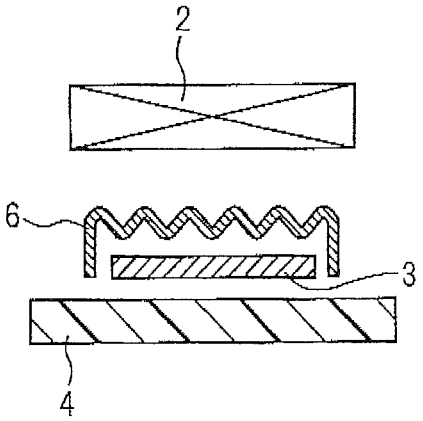
FIG. 4 illustrates anther constitution around the heating area of the washing apparatus according to the present invention.

Furthermore, preferably, a washing area of the washing apparatus further comprises a flow controlling means and an exhaust opening. The flow control means is preferably disposed over the article in such a manner that the flow controlling means cover at least a part of the article. The exhaust opening is preferably disposed below the article. As a result of the above constitution, it becomes possible to guide a substantial flow of the sprayed washing solution to the exhaust opening by the function of the flow controlling means. The flow controlling means may have any suitable configuration and size, insofar as it can ensure to guide a flow of the washing solution sprayed from the spraying nozzle in a desired direction, generally in a direction of the exhaust opening. As is explained hereinafter referring to FIGS. 3 and 4, a typical example of the flow controlling means is a flow controlling plate. In order to prevent leakage of the sprayed washing water out of the flow controlling plate, it is preferred that the flow controlling plate is formed in a rectangular shape from plastics, metals or other materials in such a manner that the plate covers a substantial portion of the article. Preferably, the flow controlling means may have a reversed U-shaped cross-section, as is illustrated in FIGS. 3 and 4.

Moreover, it is preferred that the washing apparatus further comprises a conveyer means for supporting and transporting in series a plurality of the articles. In the presence of the conveyer means, it becomes possible to guide the plurality of the articles on the moving conveyer means in sequence, continuously or intermittently, from a heating area to a washing area. In the practice of the present invention, any conventional conveyer means such as a chain conveyer and a conveyer belt may be freely used. For example, an endless conveyer means may be constituted by circulating a chain-like or net-like conveyer belt between a pair of rotating rollers. Alternatively, a conveyer means may be omitted from the washing apparatus, if the plurality of the articles are connected with each other to form a belt of the articles, since the resulting toilers can act as a conveyer means.

In the washing area, after spraying of the washing solution against the article, the sprayed washing solution can drop downwards. Accordingly, in order to recover the sprayed and dropped washing solution, it is preferred that the washing area further comprises a recovery tank for receiving the sprayed washing solution. The recovery tank is preferably disposed in a lower portion of the washing area, and is preferably in the form of a cylindrical tank or a rectangular tank. If necessary, the recovered washing solution may be recycled to the solution-supplying tank after cleaning of the same.

Next, preferred embodiments of the present invention will be described referring to FIGS. 1 and 2.

FIG. 1 illustrates a washing apparatus for longitudinal parts which constitute an aluminum-made heat exchanger product. The parts can be produced, in sequence, from an aluminum material in the conventional molding apparatuses such as a press molding machine. The washing apparatus 1 comprises a spraying apparatus 10 for spraying droplets of the super-cooled washing solution. The spraying apparatus 10 is provided with a solution-supplying tank 11 and a spraying nozzle 12. To the solution-supplying tank 11, an inactive washing solution having an oleophobicity to oils and fats, for example, an aqueous solution containing water and antirust agent or a solvent of fluorinated compound is supplied through a conduit 11*a* to store the same in the tank 11. On the other hand, air is supplied through a conduit 12*a* to the spraying nozzle 12. The air in the spraying nozzle 12 is then mixed with a washing solution supplied from the solution-supplying tank 11. In the resulting washing/drying area (W/D), a gas-liquid two phase medium comprising droplets of the super-cooled washing solution is sprayed against a part 3 to be washed. If necessary, a recovery tank 5 may be disposed in a lower portion of the washing/drying area (W/D), as is illustrated. A sprayed washing solution and any contaminations removed from the part 3 are recovered in the recovery tank 5.

The gas-liquid two phase medium can be prepared by using any conventional methods. For example, a washing solution is cooled in the solution-supplying tank 11 under the sealed and pressurized conditions to obtain a super-cooled washing solution. The super-cooled washing solution is then supplied to a spraying nozzle 12 to obtain a gas-liquid two phase medium. Alternatively, the gas-liquid two phase medium comprising droplets of the super-cooled washing solution may be prepared by using a so-called "Laval" nozzle as a spraying nozzle 12. The Laval nozzle generally comprises a throat portion having a circular cross-section, a convergent portion positioned on an upperstream side of the throat portion, and a divergent portion positioned on a downstream side of the throat portion.

According to the above method, after a cooling gas flow was prepared by utilizing an adiabatic expansion of the compressed air introduced to the Laval nozzle, the cooling gas flow is mixed with the washing solution to form a gas-liquid two phase medium comprising droplets of the super-cooled washing solution. In according to another alternative method, a gas-liquid, two phase medium comprising droplets of the super-cooled washing solution may be prepared by mixing a cooling gas flow formed by using a vortex tube with a washing solution. Preferably, a spraying apparatus 10 provided with a Laval nozzle is used in the practice of the present invention, since such a spraying system is constituted in a compact scale, and enables to spray the washing solution at a high speed of a subsonic or sonic level. As the spraying nozzle 12, a Laval nozzle having a structure described in, for example, Japanese Patent No. 4120991 and Japanese Unexamined Patent Publication (Kokai) No. 10-223587 may be used.

After they are disposed on a transporting conveyer 4, the longitudinal parts 3 are guided to the direction of an arrow A within a washing apparatus 1. The transporting conveyer 4 may be any conventional sheet-like means such as plastic sheet, netted sheet and chain sheet which are endlessly rotatable between a pair of transporting rollers. Using the transporting conveyer 4, it becomes possible to continuously guide the parts 3 from the precedent area (not shown) to the subsequent washing/drying area (W/D) of the spraying apparatus 10 for spraying droplets of the super-cooled washing solution. A heating means 2 is disposed between the precedent area and the spraying apparatus 10 in order to heat a surface of the parts 3 to a temperature of not less than a boiling point of the washing solution. As a heating means 2, a heater capable of heating the parts 3 with a radiation heat such as an infrared heater may be suitably used. However, a heating system and disposal of the heating means are not restricted, if the heating means used is effective to heat a portion, to be washed, of the parts to a surface temperature of not less than a boiling temperature of the washing solution.

If necessary, two or more spraying nozzles 12 may be disposed in the spraying apparatus 10. Further, the spraying nozzle 12 may be disposed in a direction perpendicular to the parts 3, or may be disposed in an angle inclined to the conveying direction A of the parts 3. Further, the spraying nozzle 12 may be moved in a horizontal direction. In summary, the spraying nozzle 12 may be disposed and/or scanned in any desired manners depending upon factors such as details of the parts 3. Therefore, according to the present invention, after they were continuously discharged from the precedent area, the parts 3 are guided to a heating means 2 to heat the parts 3. Then, the heated parts 3 are guided to a washing/drying area (W/D) of the subsequent spraying apparatus 10 for spraying droplets of the super-cooled washing solution. During passing through the washing/drying area, a portion, to be washed, of the guided parts 3 is sprayed with a gas-liquid two phase medium comprising droplets of the super-cooled washing solution from the spraying nozzle 12. It is therefore possible to concurrently wash and dry the parts 3 at a high speed with the resulting good washing qualities.

Figure 2:
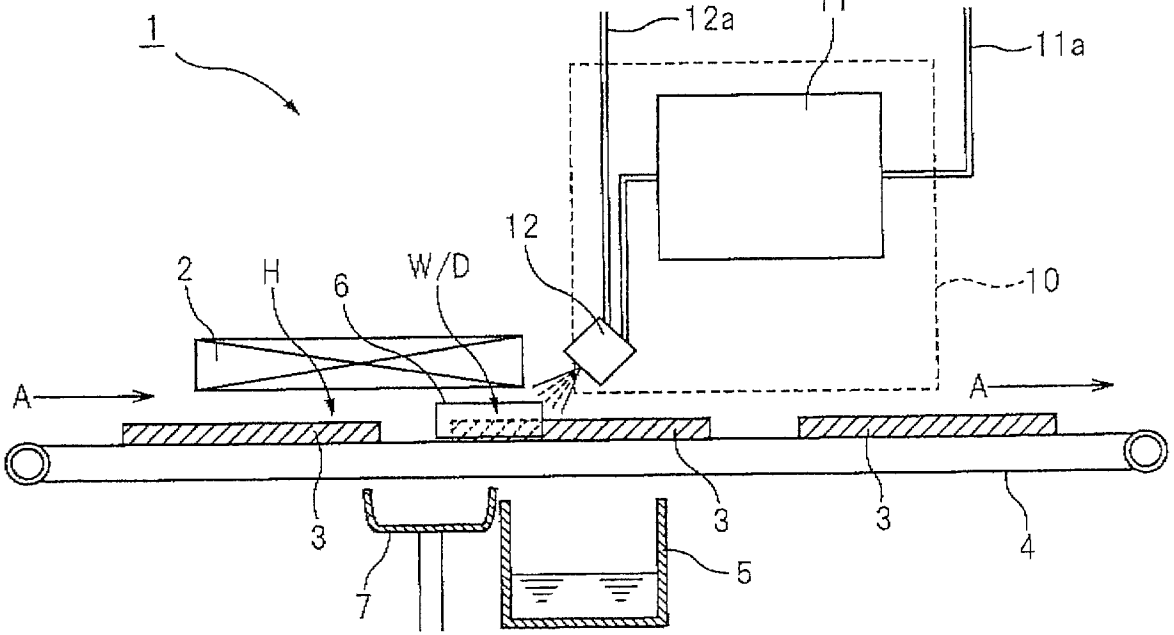
FIG. 2 illustrates another preferred embodiment of the washing apparatus according to the present invention.

FIG. 2 is a modification of the washing apparatus 1 illustrated in FIG. 1, and illustrates another preferred washing apparatus for longitudinal parts. Similarly, the longitudinal parts are produced from an aluminum material using a molding apparatus such as press molding apparatus.

The washing apparatus 1 comprises a spraying apparatus 10 for spraying droplets of the super-cooled washing solution. The spraying apparatus 10 is provided with a solution-supplying tank 11 and a spraying nozzle 12. To the solution-supplying tank 11, an inactive washing solution having an oleophobicity, for example, an aqueous solution containing water and antirust agent or a solvent of fluorinated compound is supplied through a conduit 11*a* to store the same in the tank 11. On the other hand, air is supplied through a conduit 12*a* to the spraying nozzle 12. The solution-supplying tank 11 is so constituted that a washing solution from the solution-supplying tank 11 is introduced into the spraying nozzle 12 in order to constitute a washing/drying area (W/D) in which a gas-liquid two phase medium comprising droplets of the super-cooled washing solution is sprayed against the parts 3. If necessary, a recovery tank 5 may be disposed in the washing apparatus 1 to recover a sprayed washing solution and any contaminations.

Figure 5:
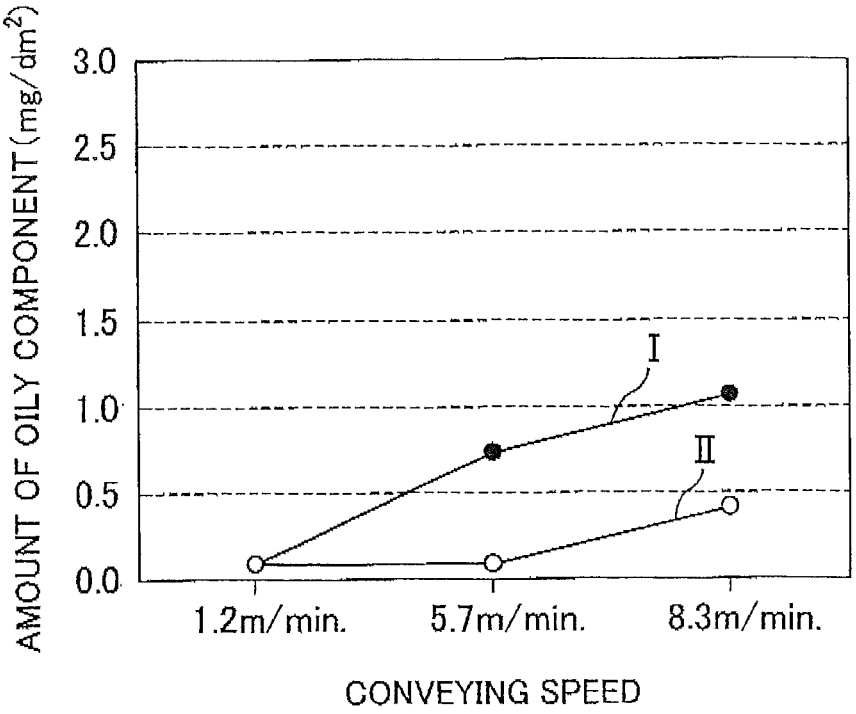
FIG. 5 is a graph of the test results showing a dependency of the washing efficiency upon the conveying speed of the conveyer means.

As is illustrated, the spraying nozzle 12 is disposed at an inclined angle with regard to the conveying direction, shown with an arrow A, of the parts 3. Further, as is illustrated in FIGS. 4 and 5, a flow controlling plate 6 capable of covering the part 3 is disposed over an upper surface of the part 3 in order to form a space in which a gas-liquid two phase medium sprayed from the spraying nozzle 12 in the washing/drying area (W/D) is guided towards an exhaust opening 7 in a heating area (H). The exhaust opening 7 connected to an exhaust apparatus (not shown) has a function of aspirating and recovering a vapor generated in the heating area (H), followed by discharging the vapor out of the washing/drying area (W/D).

The washing solution used is a super-cooled washing solution, and is in the form of a gas-liquid two phase medium- For example, the gas-liquid two phase medium can be prepared by cooling a washing solution in the solution-supplying tank 11 under the sealed and pressurized conditions, and supplying the resulting super-cooled washing solution to a spraying nozzle 12 to obtain a gas-liquid two phase medium. Alternatively, the gas-liquid two phase medium comprising droplets of the super-cooled washing solution may be prepared by using a Laval nozzle as a spraying nozzle 12. In this embodiment, after a cooling gas flow was prepared by utilizing an adiabatic expansion of the compressed air introduced to the Laval nozzle, the cooling gas flow is mixed with the washing solution to form a gas-liquid two phase medium comprising droplets of the super-cooled washing solution. In according to another alternative method, a gas-liquid two phase medium comprising droplets of the super-cooled washing solution may be prepared by mixing a cooling gas flow formed by using a vortex tube with a washing solution. Preferably, a spraying apparatus 10 provided with a Laval nozzle is used in the practice of the present invention, since such a spraying system is constituted in a compact scale, and enables to spray the washing solution at a high speed of a subsonic or sonic level. As the spraying nozzle 12, a Laval nozzle having a structure described in the patent literatures mentioned above may be used.

Using a transporting conveyer 4, the longitudinal parts 3 are continuously guided from the precedent area to the subsequent washing/drying area (W/D) of the spraying apparatus 10. A heating means 2 is disposed between the precedent area and the spraying apparatus 10 in order to heat a surface of the parts 3 to a temperature of not less than a boiling point of the washing solution. As a heating means 2, a heater capable of heating the parts 3 with a radiation heat such as an infrared heater may be suitably used. However, a heating system and disposal of the heating means are not restricted, if the heating means used is effective to heat a portion, to be washed, of the parts to a surface temperature of not less than a boiling temperature of the washing solution. If necessary, two or more spraying nozzles 12 may be disposed in the spraying apparatus 10. Further, the spraying nozzle 12 may be disposed in a direction perpendicular to the parts 3, or may be disposed in an inclined angle to the conveying direction A of the parts 3, or may be moved in a horizontal direction. That is, the spraying nozzle 12 may be disposed and/or scanned in any desired manners depending upon factors such as details of the parts 3.

In the embodiment illustrated in FIG. 2, the parts 3 continuously discharged from the precedent area are guided, in sequence, to a heating means 2, and a washing/drying area (W/D) of the spraying apparatus 10, positioned after the heating area (H). ID the washing/drying area (W/D), a portion, to be washed, of the guided parts 3 is sprayed with a gas-liquid two phase medium comprising droplets of the super-cooled washing solution from the spraying nozzle 12. It is therefore possible to concurrently wash and dry the parts 3 at a high speed with the resulting good washing qualities. Further, since a flow controlling plate 6 is disposed as a flow controlling means, it becomes possible to concentrically spray the gas-liquid two phase medium sprayed from the spraying nozzle 12 against a surface of the parts 3. Furthermore, since a flowing passage of the gas-liquid two phase medium is formed starting from the spraying nozzle 12 and ending at the exhaust opening 7, it becomes possible to prevent re-adhesion of the removed contaminations to the cleaned parts 3.

The flow controlling plate 6 illustrated in FIG. 2 may be constituted as is illustrated in, for example, FIGS. 3 and 4. The flow controlling plate 6 illustrated in FIG. 3 has a configuration of the rectangular cross-section such as horseshoe- or reversed U-shaped cross- section, and thus can cover a substantial portion of the part 3 on a moving transporting conveyer 4. Further, the flow controlling plate 6 illustrated in FIG. 4 has a configuration of the rectangular cross-section wherein a ceiling portion is corrugated in order to spray the gas-liquid two phase medium as a laminar flow against the part 3. Generally, the flow controlling plate 6 is made of a metal including metal alloy and a plastic material including fiber-reinforced plastics (FRP).

EXAMPLES

The present invention will be further described with reference to the examples thereof. However, it should be noted that the present invention are not restricted to the following examples.

Example 1

Washing and Removal of Oily Impurities from Surface of Article

The washing apparatus described above with reference to FIG. 2 was used to remove oily impurities from a surface of the parts. The washing apparatus used in this example is a washing apparatus provided with a "Laval" nozzle system, and is commercially available under the trade name "MIJ-P100" from Rix Co. Ltd., Japan.

As the oily impurities, used is a water-insoluble oil commercially available under the trade name "Yushiron Cut Abas KZ216" from Yushiro Chemical Industry Co. Ltd., Japan. The oil was coated at a coating surface of 5 mm×150 mm (0.05 $dm^2$) on a center portion of an upper surface of each of the rectangular aluminum-made test pieces.

The washing apparatus comprises a solution-supplying tank and a Laval-type spraying nozzle. A single spraying nozzle was disposed at an inclined angle of 45 degree to a coated area of the test piece. A distance between a tip of the spraying nozzle and the test piece was 20 mm. Further, a flow controlling plate was disposed in such a manner that it can be positioned over an upper surface of the moving test piece. A IR heater was disposed between the precedent area (not shown) and the washing apparatus to heat a surface of the test pieces to a temperature of not less than a boiling point of the washing solution.

In order to constitute a washing/drying area (W/D) in the washing apparatus, an inactive washing solution was supplied through a conduit to the solution-supplying tank. Deionized water was used as the washing solution, and was supplied at a flow rate of 20 ml/min. Further, a compressed air at a pressure of 0.4 MPa was supplied through a conduit to a flow of the deionized water of the spraying nozzle. As a result of the introduction of the compressed air into the washing solution of the spraying nozzle, a gas-liquid two phase medium comprising droplets of the super-cooled washing solution was sprayed against the test pieces. Since a transporting conveyer was used to support and transport the test pieces, the test pieces were continuously guided from the precedent area to the subsequent washing/drying area (W/D) of the washing apparatus.

In the washing of the moving test pieces, the test pieces could be concurrently washed and dried at a high speed with good washing qualities. Further, since a flow controlling plate was used in the spraying system, the gas-liquid two phase medium could be concentrically sprayed against a surface of the moving test pieces.

After completion of the spraying of the washing solution, the sprayed washing solution and the oil removed from the test pieces were recovered in a recovery tank disposed in a lower portion of the washing apparatus. Since an simple and effective flowing route of the washing solution was formed in the washing apparatus, re-adhesion of the removed oil to the cleaned test pieces was prevented, along with a controlled flow of washing solution.

Example 2

Determination of Dependency of Washing Efficiency of Washed Parts on Conveying Speed of Transporting Conveyer The rectangular test pieces having a width of 70 mm, a length of 150 mm and a thickness of 1 mm were produced from an aluminum material. To subject the test pieces to the following evaluation test, a center portion of an upper surface of each of the test pieces was coated with a thin layer of a contamination substance. The contamination substance was coated at a coating surface of 5 mm×150 mm (0.05 $dm^2$). The contamination substance used herein is a water-insoluble oil commercially available under the trade name "Yushiron Cut Abas KZ216" from Yushiro Chemical Industry Co. Ltd., Japan.

Next, an amount of the water-insoluble oil adhered to each test piece, i.e., amount of the adhered oily component ($mg/dm^2$), was determined with an ultraviolet absorption spectroscopy. In the first step of the determination process, an oily component was extracted on the extraction apparatus commercially available under the trade name "HC-UV45" from Tosoh Corp., Japan, followed by quantitatively analyzing the extracted liquid with an ultraviolet absorption spectroscopy using benzyl alcohol as a reference substance. An amount of the oily component of each test piece was determined from the absorbance of the ultraviolet radiation at a wavelength of 265 nm.

In the second step of the determination process, the water-insoluble oil adhered to the test piece was removed from the test piece using the washing apparatus of Example 1 described above.

When the test pieces on the transporting conveyer were guided through the washing apparatus to conduct a washing process, three different conveying speeds of 1.2 m/min., 5.7 m/min. and 8.3 m/min. were applied to the conveyer-Further, when the test pieces were conveyed, some of the test pieces as a comparative example were not heated before the washing step, and thus they were conveyed at a room temperature (25° C.), whereas some of the test pieces as an inventive example were heated before the washing step, and thus they were conveyed through a heating area at a temperature of 150° C., for the comparison purpose. In the washing process, a gas-liquid two phase medium comprising droplets of the super-cooled washing solution was sprayed against the moving test pieces.

After completion of the washing process, an amount of the oily component was measured to evaluate a dependency of the resulting washing efficiency on a conveying speed of the conveyer. The results plotted on a graph of FIG. 5 were obtained.

In the graph of FIG. 5, the curve I with the black circles represents the results for the test pieces according to the comparative examples to which heating was not applied, while the curve II with the white circles represents the results for the test pieces according to the inventive examples to which heating was applied using an IR heater.

As is appreciated from the graph, both the comparative examples and the inventive examples could satisfy a desired cleaning degree of not more than 1 $mg/dm^2$ after completion of the washing process, when the conveying speed of the conveyer was 1.2 m/min., while the unwashed test pieces had the oily component of 50 to 80 $mg/dm^2$ adhered to the test pieces in both the comparative examples and the inventive examples.

However, for the comparative examples in which the test pieces were washed in the absence of the preheating step, after completion of the washing process, the droplets of the super-cooled washing solution could be solidified and then the solidified droplets could be melted and adhered on the test pieces. With an increase of the conveying speed, an amount of the melted droplets on the test pieces could be increased, and thus a cleaning efficiency of the washing process was remarkably reduced.

Contrary to this, for the inventive examples in which the test pieces were washed after completion of the preheating step, the above drawbacks in the comparative examples such as solidification and melting the droplets of the super-cooled washing solution on the test pieces were not observed. It was observed that the droplets of the super-cooled washing solution could be evaporated after their solidification and melting. Further, it was also observed that a satisfactory cleaning effect could be maintained even if the Conveying speed was increased to 8.3 m/min.

INDUSTRIAL APPLICABILITY

As is appreciated from the above descriptions, the present invention can be effectively utilized in the washing of the articles such as those produced with press molding and other production methods to remove impurities such as oils and fats, foreign substances and the like attached to the articles. Further, the washing apparatus according to the present invention has an energy-saving and down-sizing constitution. Accordingly, the present invention can be advantageously utilized when any contaminations adhered to the parts are removed from a surface of a wide variety of parts such as automotive parts, electronics parts and mechanical parts.

The invention claimed is:

1. An apparatus for washing a longitudinal press molded article to remove contaminations on a surface of the article, the contaminations being oils and fats, the apparatus comprises in series:

a chain conveyer or a net conveyer configured for supporting and transporting in series a plurality of the articles in sequence, individually, and continuously, through a heating area to a washing area along a conveying direction at a conveying speed of 1.2 to 8.3 m/min;

the heating area comprising a heater capable of heating with radiation heat, the heater being configured to be disposed over the article and heat the article disposed in an upstream side with respect to the washing area to increase a surface temperature of the article to a temperature which is not lower than a boiling point of a super-cooled washing solution to remove at least a portion of contaminations from the surface of the article through evaporation and volatilization of such contaminations; and the washing area being configured for washing the heated article, the washing area comprising:

a spraying apparatus configured for spraying the super-cooled washing solution having an oleophobicity to the contaminations on the article, the spraying apparatus comprising:

a solution-supplying tank configured for containing the super-cooled washing solution; and a spraying nozzle connected to the solution-supplying tank, the spraying nozzle being a Laval nozzle disposed at an inclined angle with respect to the conveying direction, and the spraying nozzle in combination with an air-supplying conduit are configured to prepare the super-cooled washing solution in a form of a gas-liquid medium having two phases, where the super-cooled washing solution is prepared by preparing a cooling gas flow by utilizing an adiabatic expansion of a compressed air introduced to the Laval nozzle, followed by mixing the cooling gas flow with the washing solution;

an exhaust opening configured to be disposed below the article;

a flow controlling plate capable of covering at least a part of the article, where the flow controlling plate is configured to be disposed over the article, the flow controlling plate has a reversed U-shaped cross-section that forms a space in which the super-cooled washing solution sprayed from the spraying nozzle is guided towards the exhaust opening, and a flow of the sprayed super-cooled washing solution is substantially guided from the space to the exhaust opening; and a recovery tank for receiving the sprayed super-cooled washing solution, the tank being disposed in a lower portion of the washing area;

wherein the washing area is configured such that washing and drying of the heated article are concurrently carried out by spraying the super-cooled washing solution against the heated article in the washing area to remove the remaining contaminations, which are not evaporated or volatilized during heating in the heating area, by rubbing the surface of the article with the super-cooled washing solution, while causing in the sprayed super-cooled washing solution a spontaneous phase transition (liquid→solid→gas) of super-cooled droplets of the washing solution.

2. The apparatus according to claim 1, in which the contaminations further comprise at least one selected from the group consisting of foreign substances, particulates, burrs and a combination thereof.

3. The apparatus according to claim 1, wherein the flow controlling plate is disposed below the heater.

* * * * *